US009017189B2

(12) United States Patent
Leath

(10) Patent No.: US 9,017,189 B2
(45) Date of Patent: Apr. 28, 2015

(54) TRAINING SLED

(75) Inventor: Chad Leath, Austin, TX (US)

(73) Assignee: Chad Amos Leath, Natchitoches, LA (US)

( * ) Notice: Subject to any disclaimer, the term of this patent is extended or adjusted under 35 U.S.C. 154(b) by 461 days.

(21) Appl. No.: 13/179,441

(22) Filed: Jul. 8, 2011

(65) Prior Publication Data

US 2013/0012364 A1 Jan. 10, 2013

(51) Int. Cl.

| | |
|---|---|
| ***A63B 69/34*** | (2006.01) |
| ***A63B 69/00*** | (2006.01) |
| ***A63B 21/012*** | (2006.01) |
| ***A63B 21/00*** | (2006.01) |
| ***A63B 23/04*** | (2006.01) |
| *A63B 21/055* | (2006.01) |
| *A63B 21/06* | (2006.01) |
| *A63B 71/02* | (2006.01) |

(52) U.S. Cl.

CPC ..... *A63B 21/012* (2013.01); *A63B 69/34* (2013.01); *A63B 69/345* (2013.01); *A63B 21/0552* (2013.01); *A63B 21/06* (2013.01); *A63B 21/1476* (2013.01); *A63B 21/1484* (2013.01); *A63B 21/1492* (2013.01); *A63B 23/047* (2013.01); *A63B 2071/025* (2013.01)

(58) Field of Classification Search

USPC ..... 473/441–445, 422; 482/90, 112, 130, 482/133, 129; 434/251

See application file for complete search history.

(56) References Cited

U.S. PATENT DOCUMENTS

| | | | | |
|---|---|---|---|---|
| 1,962,088 | A * | 6/1934 | Crowther | 473/445 |
| 3,218,070 | A * | 11/1965 | Crowther | 473/441 |
| 3,804,410 | A | 4/1974 | Gilman | 473/445 |
| 4,087,089 | A * | 5/1978 | Forrest | 473/445 |
| 5,013,039 | A * | 5/1991 | Cole | 473/445 |
| 5,143,372 | A * | 9/1992 | Wilson | 473/442 |
| 5,458,551 | A * | 10/1995 | Shenton | 482/83 |
| 5,462,272 | A * | 10/1995 | Staten | 473/445 |
| 5,637,063 | A * | 6/1997 | Fuller, Sr. | 482/97 |
| 5,743,821 | A * | 4/1998 | Wirachowski | 473/441 |
| 5,921,896 | A * | 7/1999 | Boland | 482/83 |
| 6,761,650 | B1 | 7/2004 | Dettman | 473/445 |
| 6,802,799 | B2 * | 10/2004 | Gomez | 482/83 |
| 6,942,585 | B1 | 9/2005 | Krause | 473/445 |
| 7,322,893 | B2 * | 1/2008 | Bright | 473/441 |
| 7,377,883 | B1 * | 5/2008 | Blanton | 482/90 |
| 7,527,568 | B2 * | 5/2009 | Joseph | 473/441 |

OTHER PUBLICATIONS

Power Runner Machine Description (Website) Viewed Jul. 8, 2011 at http://www.forgeequipment.com/Facilities.htm (printout provided on with Jul. 8, 2011 IDS) (Forge Equipment LLC—Author).

* cited by examiner

*Primary Examiner* — Mitra Aryanpour

(57) ABSTRACT

A training sled and service promote proper form when running. The training sled is configurable for adding weights in some embodiments to increase friction and provide for weight-training by lifting portions of the sled. Sled components are slidably or pivotably connected to permit lifting a shoulder member of the sled to different heights for exercise, and to achieve an optimal training angle for an athlete to train.

7 Claims, 8 Drawing Sheets

TRAINING SLED

BACKGROUND

The present disclosure relates to resistance based exercise equipment, and particularly to training sleds.

RELATED ART DESCRIPTIONS

Training sleds are used by athletes for resistance training. Athletes can push the training sleds to promote physical conditioning.

BRIEF DRAWING DESCRIPTIONS

SUMMARY OF DISCLOSED EMBODIMENTS

Figure 1:
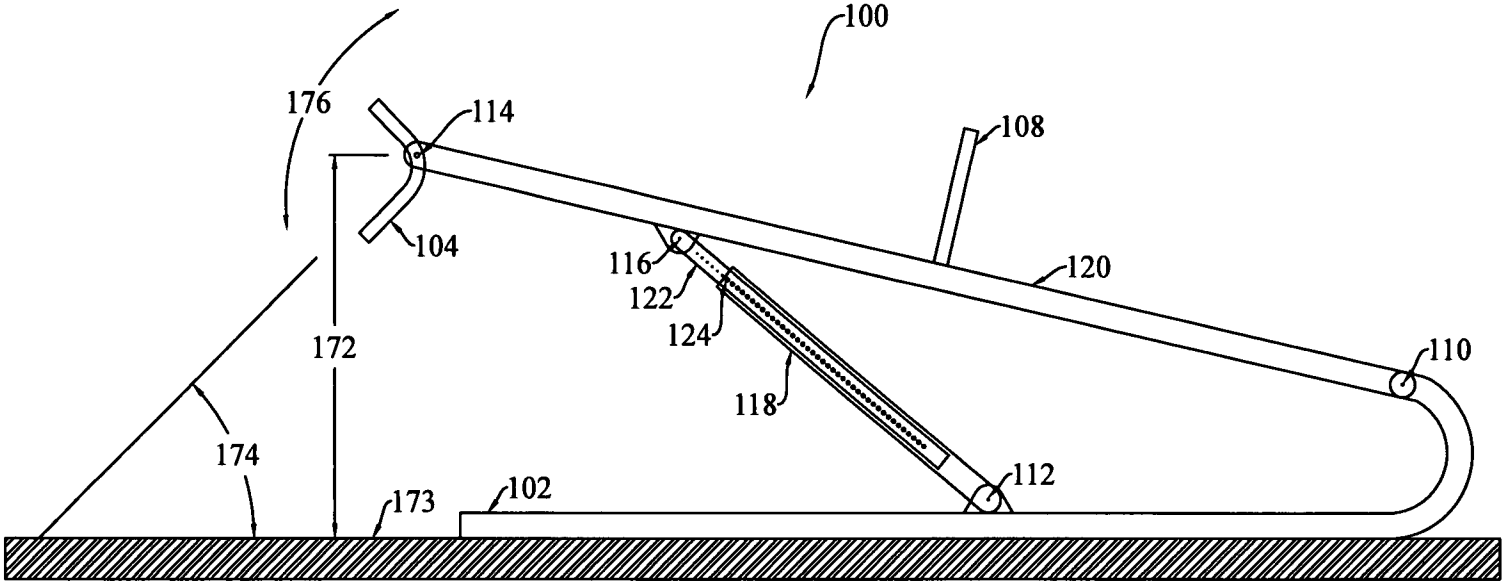
FIG. 1 depicts a side view of an embodied training sled at a first height.

An exemplary embodiment is a training sled comprising an upper member connected to a shoulder member. The shoulder member contacts an athlete's shoulders and may be padded. The shoulder member is positioned on the training sled and formed (e.g., formed at a 90° angle) to promote the athlete using the training sled at an optimized training angle (e.g., a 45° angle) to the ground. The athlete's use of the training sled at the optimized training angle simulates actual running conditions ideal for obtaining top speed as a sprinter, for example. The optimized training angle and arrangement (e.g., height and angle of rotation) of the shoulder member also encourages an athlete while using the training sled to pump his or her arms in a manner that conditions the athlete for faster running in competition. Further, the optimized training angle and arrangement of the shoulder member encourages proper hip placement while using the sled. Accordingly, the upper member positions the shoulder member at a height and angle of rotation for the athlete that achieves the optimized training angle for the athlete. For a sprinter in some scenarios, the height of the sprinter's shoulders when the sprinter is running at a 45° angle (an example optimized training angle) to the ground determines the height at which to set the shoulder member.

In addition to the upper member and shoulder member, the training sled further includes a friction member pivotably connected to the upper member and a cross member. The cross member provides support and rigidity between the friction member and upper member. The cross member is extendable and pivotably connected to the upper member via a cross member union. The cross member union may comprise a lap joint and a pin (i.e., a cross member pin) that permits the cross member to rotate compared to the upper member as the cross member is extended during use of the training sled or height adjustments of the training sled. The cross member is also pivotably connected to the friction member. Therefore, the cross member is adjustable to promote the shoulder member contacting the athlete at the optimized training angle for a particular training regimen.

In some embodiments, the training sled includes one or more weight holders that results in additional resistance between the friction member and a training surface. For example, the weight holder may be used for adding weight in amounts that increase friction to a desired amount on training surfaces such as grass or a gymnasium floor. The weight holder may be connected to the upper member, the friction member, or the shoulder member. In another scenario, the weight holder provides weight lifting type resistance for the athlete. Accordingly, the weight holder can be connected to the upper member, and the cross member pin can be positioned (e.g., removed from a cross member hole and placed in a cross member extender hole) to permit the cross member to extend upward a given distance and to prevent the cross member from contracting passed a desired point (i.e., from dropping too far). The athlete can perform shoulder presses while grasping the upper member or shoulder member, for example. This results in the athlete lifting weights held by the weight holder. In another scenario, resistance elements (e.g., rubber resistance band) can be connected between the friction member and upper member to provide resistance when extending the cross member. Chains can be fastened to the upper member or weight holder to provide both added friction with the training surface when pushing the sled and providing weight for when the athlete presses the upper member overhead.

A similar embodiment is a sled including a shoulder member for contacting an athlete when the athlete is at an optimized training angle to a training surface. The sled further includes an upper member coupled to the shoulder member. A friction member is coupled to the upper member via a cross member. In some embodiments, the sled includes a weight holder coupled to the upper member or friction member. Likewise, the cross member may be pivotable relative to the friction member. The upper member may be connected to and pivotable relative to the friction member, and the cross member may be extendable via a cross member extender. The cross member extender may slide within the cross member and be connected to the cross member via a cross member pin. The cross member pin can be removed and replaced for adjusting the shoulder member for contacting different athletes at an optimized training angle for each athlete. In some embodiments, the shoulder member is pivotable compared to the upper member. The shoulder member may be pivotable within a range during operation, and otherwise fixed to promote the athlete using the sled at the optimize training angle for that athlete or for a particular training regimen. An extendable cross member and adjustable shoulder member promotes achieving the optimized training angle for an athlete and accordingly promotes desired athlete conditioning.

Another embodiment is a service for providing a sled (and related training instruction) that includes a friction member and a shoulder member adjustable to height and shaped to promote a user pushing the sled at an optimized training angle. The service may include adjusting the sled by extending a cross member so the athlete contacts the shoulder member while running and pushing the sled with an optimized training angle to the training surface of about 45.° Alternatively, the optimized training angle may be another angle between about 40° and 60°, for example. The service may include providing weights (e.g., steel weights, chains) for the sled to increase friction between the friction member and training surface. The service may also include providing the weights to permit the athlete to press a portion of the sled (e.g., through overhead presses). For example, the athlete may press a portion of the sled overhead in a military-press type exercise while the friction member remains substantially motionless in the lateral direction compared to the training surface (as compared to when the sled is pushed across ground or other training surface). In another exercise, the sled may be pushed simultaneously across the ground while performing military-press type exercises and the like.

DESCRIPTION OF EMBODIMENTS

Embodied systems include a training sled that promotes a user operating the training sled at an optimized training angle. FIG. 1 depicts an exemplary sled 100 that is adjustable to achieve an optimized training angle (e.g., 45°) while used by an athlete. Sled 100 includes a friction member 102 which contacts training surface 173. Training surface 103 may be an outdoor surface such as grass, dirt, asphalt, or artificial grass. Training surface 103 may also be an indoor surface such as a gymnasium floor. A coating (not depicted) may be added to the friction member to affect (i.e., increase or decrease) the resistance when sliding sled 100 across training surface 173.

As shown, sled 100 includes upper member 120, which is connected to or in communication with shoulder member 104. Shoulder member 104 contacts an athlete's shoulders and is positioned to maintain an optimized training angle 174 of the athlete during use. The optimized training angle is the angle between the athlete and training surface 173 as the athlete effectively leans into shoulder member 104 while using the sled. For example, for a sprinter, an optimized training angle may be 45°. In FIG. 1, the optimized training angle would be achieved by ensuring training angle 174 is 45° compared to training surface 173 during use of the sled by the sprinter. Accordingly, as depicted in FIG. 1, sled 100 is adjusted to height 172 (e.g., 4'8") for a particular sprinter to achieve a value of 45° as the optimized training angle 174. So when the sprinter leaned into shoulder member 104 to push sled 100 to the right of the page, height 172 would contact the athlete's shoulders as the athlete pumped his or her hands as when running.

As shown in FIG. 1, sled 100 includes upper member 120 connected to or communicatively coupled to shoulder member 104. As shown, shoulder member 104 is connected by shoulder member union 114. Shoulder member union 114 may include a bolt, weld, or other form of connection to upper member 120. In some embodiments, shoulder member union 114 permits adjustment of shoulder member 104 to promote optimized training angle 174 (e.g., 45°) for a particular height 172 (e.g., 5'1" shoulder height). In other embodiments, shoulder member union 114 may permit rotation of shoulder member 104 within a range (e.g., a range permitting an optimized training angle range of between 40° and 60° between the athlete and training surface) while operating sled 100.

Cross member 118 adjusts (e.g., extends, contracts, stretches, compresses) to allow adjustment of height 172. As shown, cross member 118 is coupled to cross member extender 122. Cross member extender 122 is pivotably (i.e., able to be pivoted) connected to upper member 120 by upper cross member union 116. Likewise, cross member 118 can pivot in relation to friction member 102 by lower cross member union 112. Upper member 120 is pivotably connected to friction member 102 by upper member union 110. Such pivot connections allow changes in height 172 to promote achieving optimized training angle 174. Cross member pin 124 may be placed through a hole in cross member 118 and simultaneously through a particular hole in a series of holes in cross member extender 122 to achieve a desired height 172.

In FIG. 1 sled 100 is illustrated with optional weight holder 108. Weight holder 108 may be stacked with steel weights to increase friction between friction member 102 and training surface 173. In addition, adding weights to weight holder 108 provides downward force on upper member 120 and accordingly to shoulder member 104 as an athlete uses sled 100. At an optimized training angle such as 45°, a substantial upward force may be applied by the athlete to shoulder member 104. Adding weights to weight holder 108 may prevent unwanted lifting of sled 100. Weight holder 108 may also be adjustable in directions left to right along sled 100 to achieve, for a given amount of weight added to weight holder 108, a desired amount of friction between friction member 102 and training surface 173 while providing desired down force to an athlete through shoulder member 104.

Sled 100 in FIG. 1 may be used for shoulder presses or leg presses by an athlete. For such cases, sled 100 permits increasing height 172 to a particular height (e.g., the maximum height an athlete can reach with his arms overhead while doing a press), while preventing height 172 from falling below a certain height (e.g., an athlete's shoulder level). Accordingly, cross member extender 122 and cross member 118 may be configured to permit extending their combined effective length while preventing too much contraction of their combined effective length. This may be achieved if cross member pin 124 is installed in a hole in cross member extender 122 but not in cross member 118.

Sled 100 may be fabricated from suitable materials including but not limited to tubular plastics, metals, alloys, synthetic materials, and the like. FIG. 1 depicts a two-dimensional view of sled 100, which may include a further upper member, cross member, cross member extender, friction member, and so on. For clarity, such additional members are not expressly depicted in FIG. 1, but may be indicated in other figures and described below. Also, FIG. 1 and its components are not necessarily drawn to scale and the proportion of elements compared to each other may change as needed for given applications. In an exemplary embodiment, upper member 120, shoulder member 104, friction member 102, cross member 124, and weight holder 108 are fabricated from a cylindrical alloy (e.g., steel pipe, aluminum pipe, tubular steel). In addition, in this exemplary embodiment, upper member 120, shoulder member 104, friction member 102, cross member 124, cross member extender 122, have corresponding (i.e., further) elements in a third dimension not depicted in the two-dimensional representation in FIG. 1. Furthermore, friction member 102 and its corresponding friction member (not depicted in FIG. 1) may be distanced from each other wider than the distance between upper member 120 and its corresponding upper member (not depicted in FIG. 1). This increased distance between friction members compared to upper members promotes stability when operating sled 100 and may result in an aesthetically pleasing design. In addition, since the shoulder member 104 (and any corresponding shoulder member in a third dimension not depicted) is connected to upper member 120, the distance between upper members can be a built or adjustable to allow shoulder member 104 and any corresponding shoulder members to comfortably contact an athlete.

Figure 2:
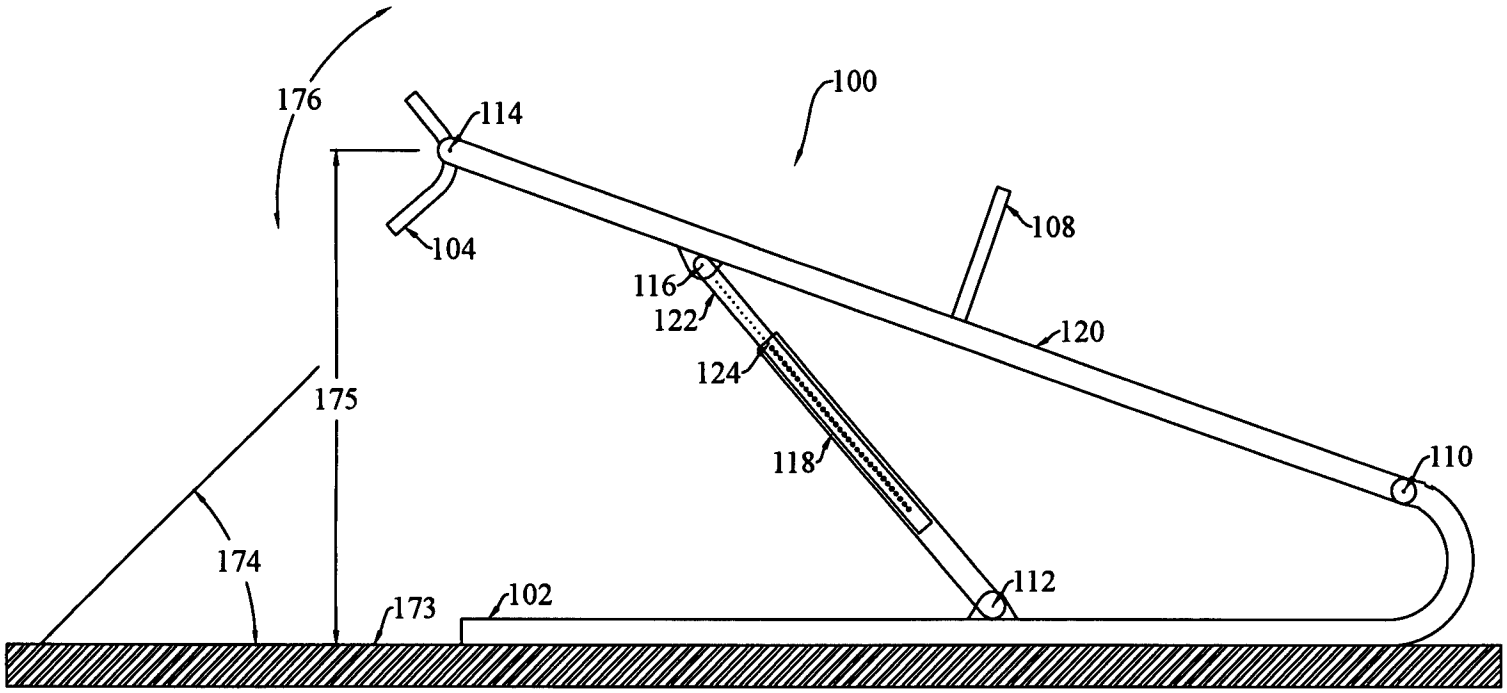
FIG. 2 depicts a side view of an embodied training sled at a second height.

FIG. 2 depicts sled 100 from FIG. 1 with shoulder member 104 at height 175. Height 175 in FIG. 2 is higher than height 172 of shoulder member 104 depicted in FIG. 1. Raising shoulder member 104 can be achieved by removing cross member pin 124 and pressing upward on upper member 120 or shoulder member 104. This causes an effective lengthening of cross member 118, which occurs by cross member extender 122 sliding out of cross member 118. When the desired height 172 is achieved, cross member pin 124 can be replaced through cross member extender 122 and cross member 118. The desired height can be the height for a particular athlete that promotes a training angle 174 of between 40° and 60°. This is the optimized training angle for an athlete. For a sprinter, for example, the optimized training angle may be 45° to simulate a sprinter leaving starting blocks and beginning a competitive sprint.

For certain uses of sled 100 in FIG. 2, an optimized training angle (corresponding to training angle 174) for a sprinter is approximately 45°. For example, operating sled 100 at a training angle 174 of 45° may promote an improvement in the sprinters speed while simultaneously promoting proper sprinting form. With the sprinter driving his or her shoulders into shoulder member 104 while achieving a training angle 174 of 45° (i.e., an optimized training angle for a particular exercise and athlete), the sprinter can work to have proper arm movement including pumping arms in synchronization with pushing the sled with leg force. Friction member 102 sliding on training surface 173 provides resistance for the sprinter. The resistance is affected by the amount of friction between training surface 173 and friction member 102. The amount of friction is affected by the materials used in making friction member 102, the weight of sled 100, the makeup of training surface 173, and such factors. To adjust the amount of friction and therefore adjust the amount of resistance of sled 100, weight can be added to weight holder 108.

In FIG. 2, the dimensions of the components of sled 100 are not necessarily limited to particular sizes, and the relative sizes and proportions of components of sled 100 are shown as examples and are not meant to necessarily limit claimed embodiments. In a particular embodiment, the length of friction member 102 along training surface 173 is approximately 92" and height 175 is adjusted to contact a 6' tall sprinter when the sprinter is leaning into sled 100 at an optimized training angle of 45° (i.e., training angle 174 is 45°). As shown by arc 176, upper member 120 (and accordingly shoulder member 104) swing through an arc when cross member 118 and cross member extender 122 are extended or retracted during adjustment or during upper body exercises performed with the sled. Upper member union 110 acts as a pivot point for upper member 120, which rotates about upper member 110 during adjustments to achieve training angle 174 as an optimized training angle. Lower cross member union 112 and upper cross member union 116 serve as pivot points for cross member 118 and cross member extender 122. Shoulder member union 114 can be adjusted and fixed in some embodiments to promote restricting an athlete to using sled 100 at a training angle 174 that is an optimized training angle (e.g., 45°). Accordingly, shoulder member union 114 is adjustable and fixable for a particular height 175 so that when an athlete uses sled 100 at the optimized training angle, his shoulders line up with the components of shoulder member 104.

Figure 3:
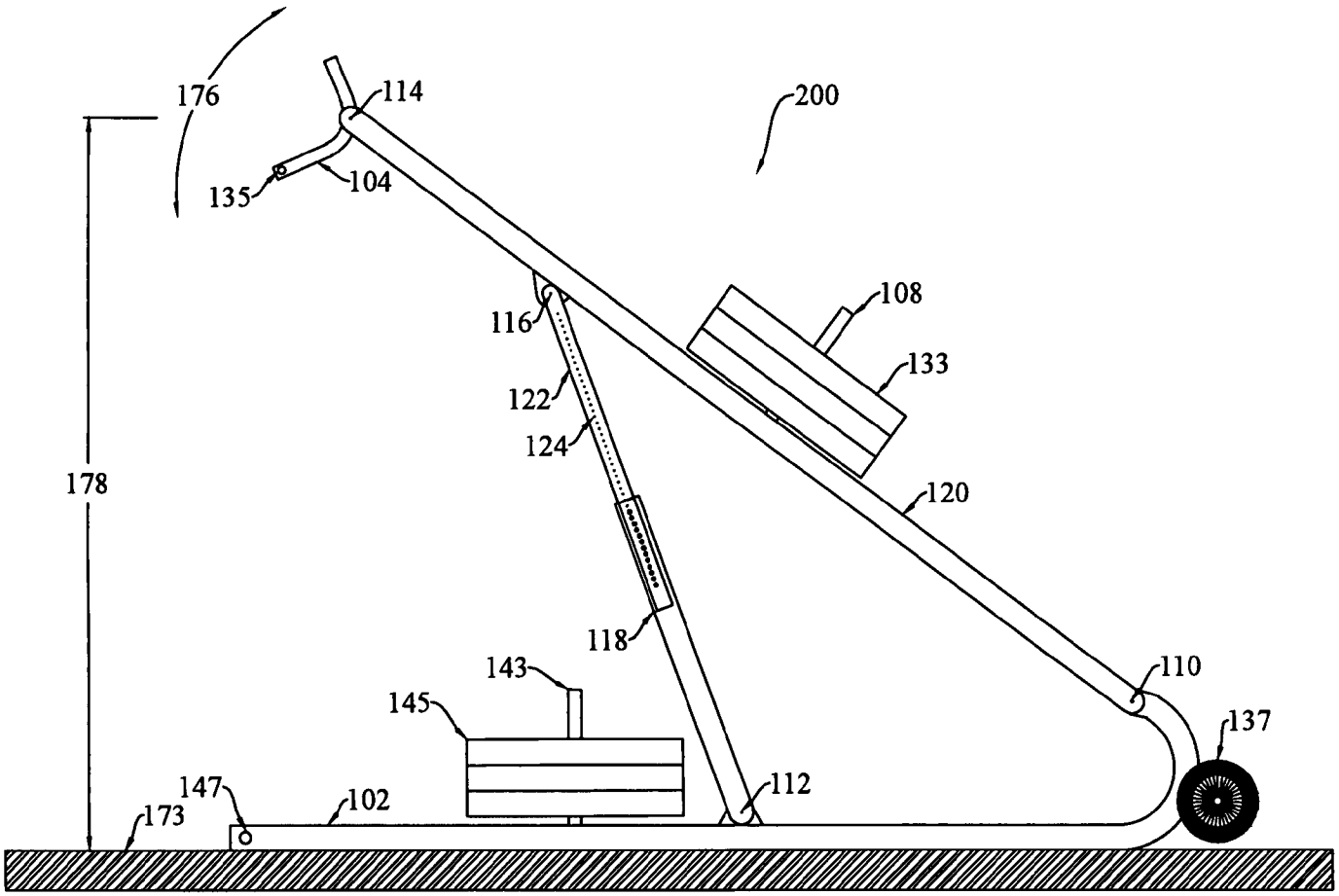
FIG. 3 depicts a side view of an embodied training sled at a third height, with additional features including a wheel and added weights.

In addition to providing resistance training for running, embodied sleds can be used for upper body workouts by the user pressing components overhead, for example. FIG. 3 depicts an embodied sled 200 with further features including weights 133 which are placed on weight holder 108. As shown, height 178 is relatively high, and cross member extender 122 is extended from cross member 118 farther than in FIG. 1 and FIG. 2. An embodied service may include instructing a user to press shoulder member 104 or upper member 120 and associated components overhead through arc 176 to height 178. Cross member pin 124 can be removed from a hole in cross member 118 to free cross member extender 122 to extend out of cross member 118. Cross member pin 124 can be installed in a hole in cross member extender 122 (while the cross member pin 124 is not installed in a hole in cross member 118) to prevent upper member 120 (under the weight of weight 133) from dropping too low (e.g., below a user's shoulder height) while permitting a pressing action by an athlete to height 178. For an athlete approximately 1.8542 meters (6'1") tall, height 178 may be in the range of approximately 2.032 meters or 2.1336 meters (6'-8" or 7'-0"), but embodied sleds should allow for an acceptable range of motion to accommodate athletes of expected sizes.

Other optional features depicted in sled 200 of FIG. 3 include pressing handle 135 which may be a cylindrical tube (that as depicted would come out of the page) gripped by an athlete to press shoulder member 104 overhead. In such cases, pivotal shoulder member union 114 may be fixed to prevent or limit shoulder member 104 pivoting during pressing motions. Pivot connection 116 and pivot connection 112 provide rotation between cross member components compared to upper member 120 and friction member 102. This allows pressing shoulder member 104 to height 178 and other heights. Pivot connection 116 and pivot connection 112 may include lap joints, pinned connections, hinged connections, flexible connections, and so on, the details of which are not necessarily critical to the function and operation of sled 200 for achieving an optimized training angle with added features for providing alternate pressing exercises.

Also as depicted in FIG. 3, sled 200 includes wheel 137 for more easily moving sled 200 along training surface 173 during certain situations. For example, if sled 200 encounters a hill, wheel 137 may assist an athlete or service provider by allowing for easier passage up the hill. In other situations, a service provider or athlete may pick up sled 200 (or a portion of sled 200) while grasping handle 147 (which as shown may protrude from the page). An embodied service may include instructing an athlete to move the sled forward or backward (right or left as depicted in FIG. 3) while lifting the sled and rolling it on wheel 137. As shown in FIG. 3, lifting sled 200 on wheel 137 could be accomplished by lifting a portion of friction member 102 or by lifting handle 147. Weight 145 positioned on optional weight holder 143 and/or weight 133 positioned on weight holder 108 provides resistance to lifting, and contributes to athlete conditioning.

As shown in FIG. 3, optional weight holder 143 is adapted for removably holding weight 145 for increasing friction between friction member 102 and training surface 173. Alternatively, weight 145 provides resistance when an athlete lifts sled 200 by handle 147 (while other portions of friction member 102 including wheel 137 remain on training surface 173).

Figure 4:
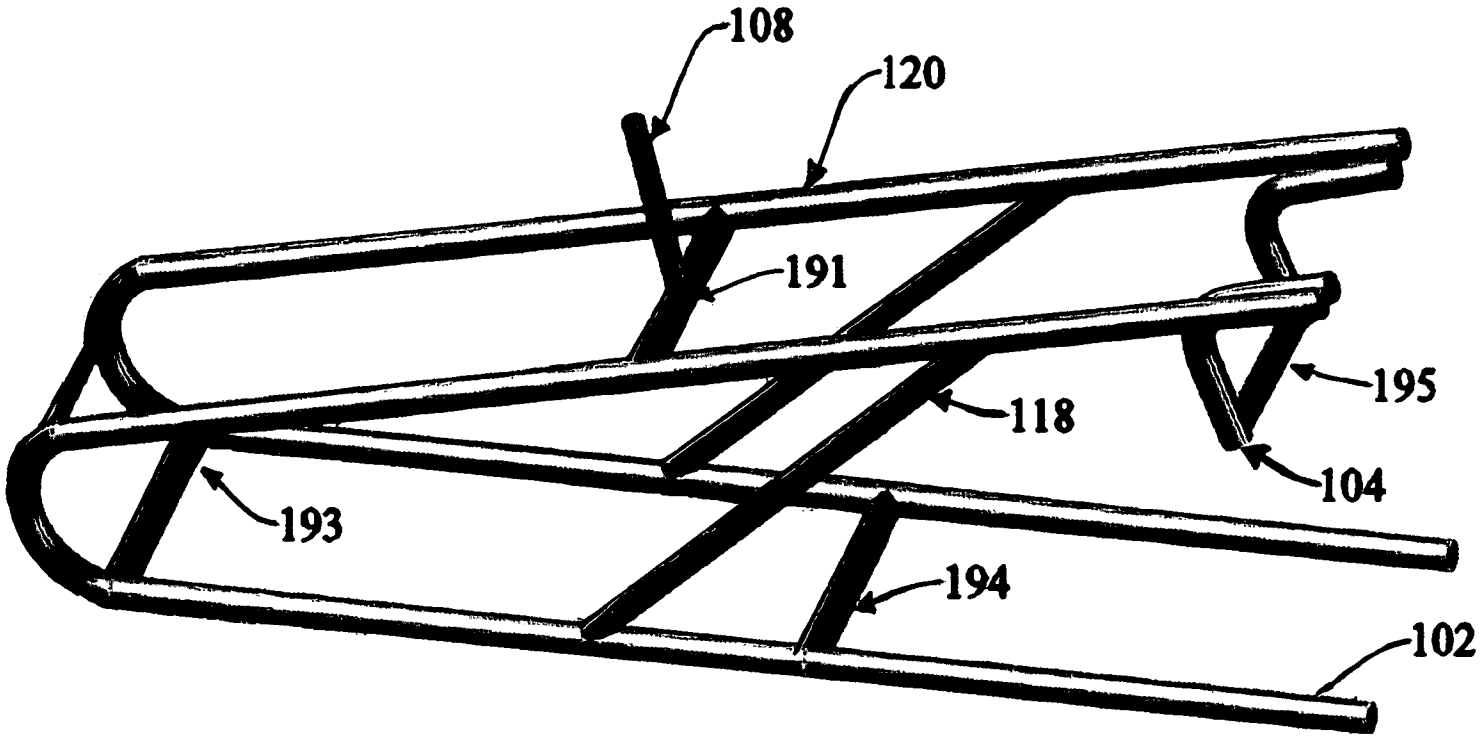
FIG. 4 represents a three dimensional depiction of features of an embodied training sled.

FIG. 4 depicts, in an arbitrary three dimensional view, certain features of an embodied sled such as sled 200 (FIG. 3) or sled 100 (FIG. 1 and FIG. 2). Other features (e.g., details of pivot members or cross member 118 used for extending upper member 120) are not depicted in FIG. 4 for simplicity but these details may be incorporated in embodied sleds nonetheless as needed for achieving a sled that promotes an athlete (or series of athletes of different sizes) training at one or more optimized training angles. Support member 194 provides support between friction member 102 and a corresponding friction member depicted. Friction member 102 and its corresponding friction member may be a greater distance apart than the distance between upper member 120 and its corresponding upper member, which are connected to each other by support member 191. As shown, support member 191 also supports optional weight holder 108. As depicted, on the end of friction member 102 toward shoulder member 104, where the athlete would be positioned, farthest from support member 193, the sled may have a wider stance (compared to the end of sled near support member 193). This promotes sled stability during use and may help prevent an athlete from stepping on friction members 102 in certain scenarios and embodiments, like where friction member 102 extends past (toward the right and out of the page) shoulder member 104 and support member 195. Shoulder member 104 and support member 195 are sized to comfortably contact an athlete. Support member 195 and shoulder member 104 may include a pad (not depicted) for comfortably contacting an athlete. As shown, shoulder member 104 is curved for contacting an athlete and may be pivotably connected to upper member 120 to permit adjustment to promote the athlete using the sled at an optimized training angle (e.g., between 40° and 60° to the ground). Additionally, upper member 120, shoulder member 104, support member 195, and cross member 118 may be positioned to allow realistic or exaggerated pumping of the arms by athletes using the sled, to condition the athlete for running conditions and to improve athlete performance. The sled depicted in FIG. 4 may be made of components such as tubular steel or aluminum. Sled 100 may be made of carbon fiber or synthetic materials.

Figure 5:
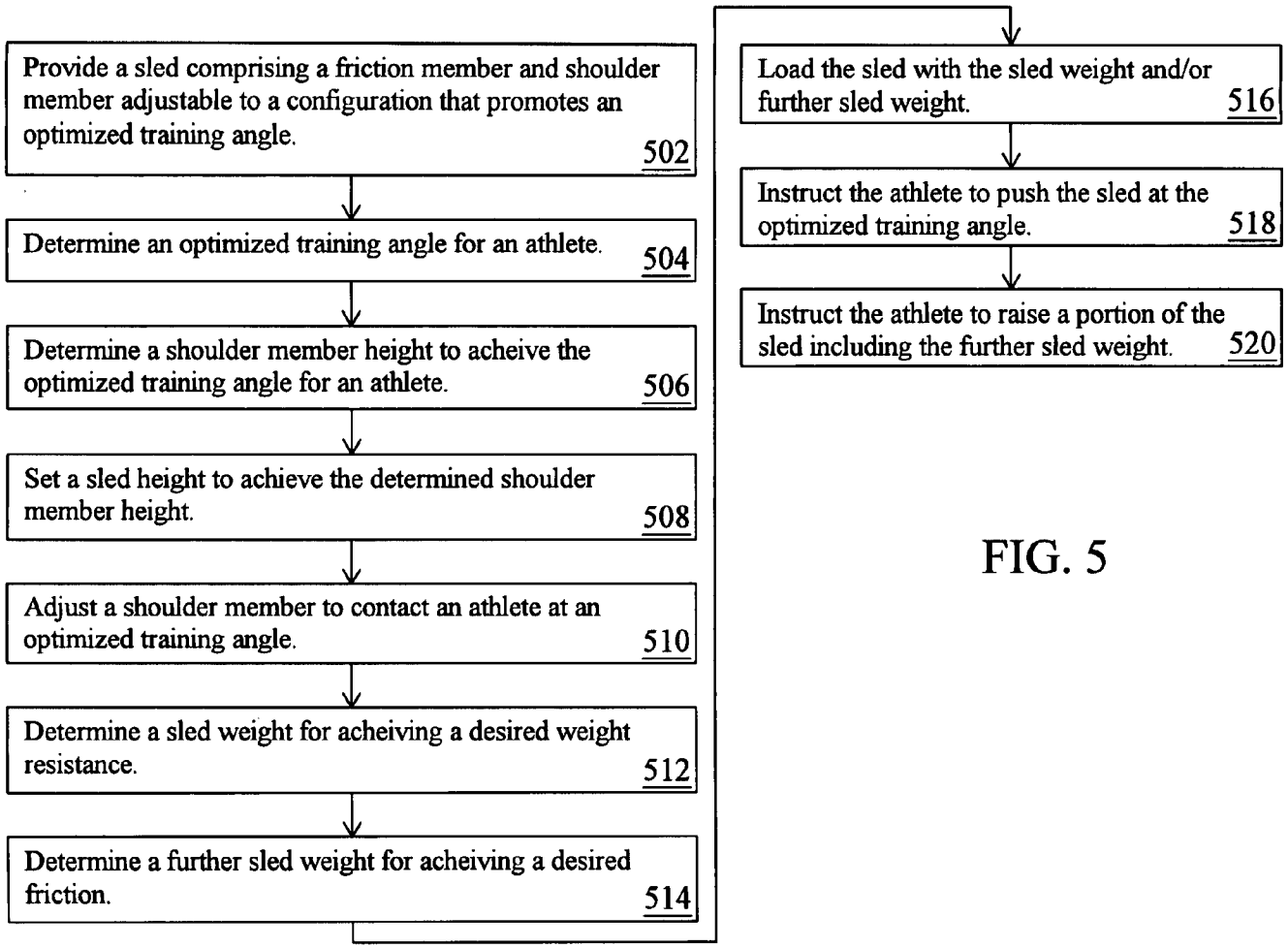
FIG. 5 depicts aspects of an embodied service for a training sled.

FIG. 5 depicts aspects of an embodied method or service for training an athlete including box 502 for providing a sled (e.g., sled 100 in FIG. 1) comprising a friction member and shoulder member adjustable to a configuration that promotes an optimized training angle. Box 504 relates to determining an optimized training angle for an athlete. The optimized training angle may be different for conditioning an athlete for various objectives, such as improving quickness out of racing blocks, improving acceleration, improving top speed during a sprint, and the like. For a sprinter to improve an overall speed in an 800 meter (874.891 yard) race and to promote good form, an optimized training angle of 45° may be used. Box 506 relates to determining a shoulder member height to achieve the optimized training angle for the athlete. This determination may be made mathematically or by observing the athlete during sprinting, by experimentation, or by trial and error, as examples. Box 508 relates to setting a sled height to achieve the determined shoulder member height. For sled 100 in FIG. 1, this may be achieved by removing extension member pin 124 from extension member extender 122 (FIG. 1) and extension member 118 (FIG. 1) and reinstalling through these components once the proper height 172 (FIG. 1) is achieved for shoulder member 104 (FIG. 1). Box 510 relates to adjusting the shoulder member (e.g. shoulder member 104 in FIG. 1) to contact the athlete at the optimized training angle (e.g., an angle 174 of 45° in FIG. 1). Box 512 relates to determining a sled weight for achieving a desired weight resistance for an athlete. Referring to FIG. 3, box 512 may relate to determining an amount of weight 133 for adding to weight holder 108 to provide resistance when an athlete lifts upper member 120 and shoulder member 104 overhead.

Referring to FIG. 5, box 514 is for determining a further sled weight for achieving a desired friction for an embodied sled. In FIG. 3, the weight for achieving the desired friction would be included with weight 145 on weight holder 143. The weight contributes to stability of the sled and contributes to friction between friction member 102 (FIG. 3) and training surface 173 (FIG. 3). The weight also contributes to the overall weight of the sled and prevents an athlete from lifting the sled while using it for resistance during run training. In some embodiments, weight holder 143 is a platform or includes a platform and weight 145 includes body weight from a service provider or other person. Box 516 relates to loading the sled with the sled weight for achieving weight resistance and with the further weight for achieving a desired level of friction between the sled and training surface. Box 518 relates to instructing an athlete to push the sled at an optimized training angle (e.g., 45° for a sprinter). Box 520 relates to instructing an athlete to raise a portion of an embodied sled for resistance training. For example, for sled 200 (FIG. 3), box 520 relates to instructing an athlete to raise shoulder member 104, and accordingly upper member 120, overhead to height 178. This may be achieved by using handle 135, which as shown, extrudes from the page and provides the athlete a lifting mechanism. For such an operation, shoulder member union 114 may be mechanically fixed (e.g., by tightening a bolt/nut combination holding shoulder member 104 to upper member 120, or shoulder member 104 may otherwise rotate to a stopping point against a component (e.g., rubber bumper) of upper member 120.

Figure 6A:
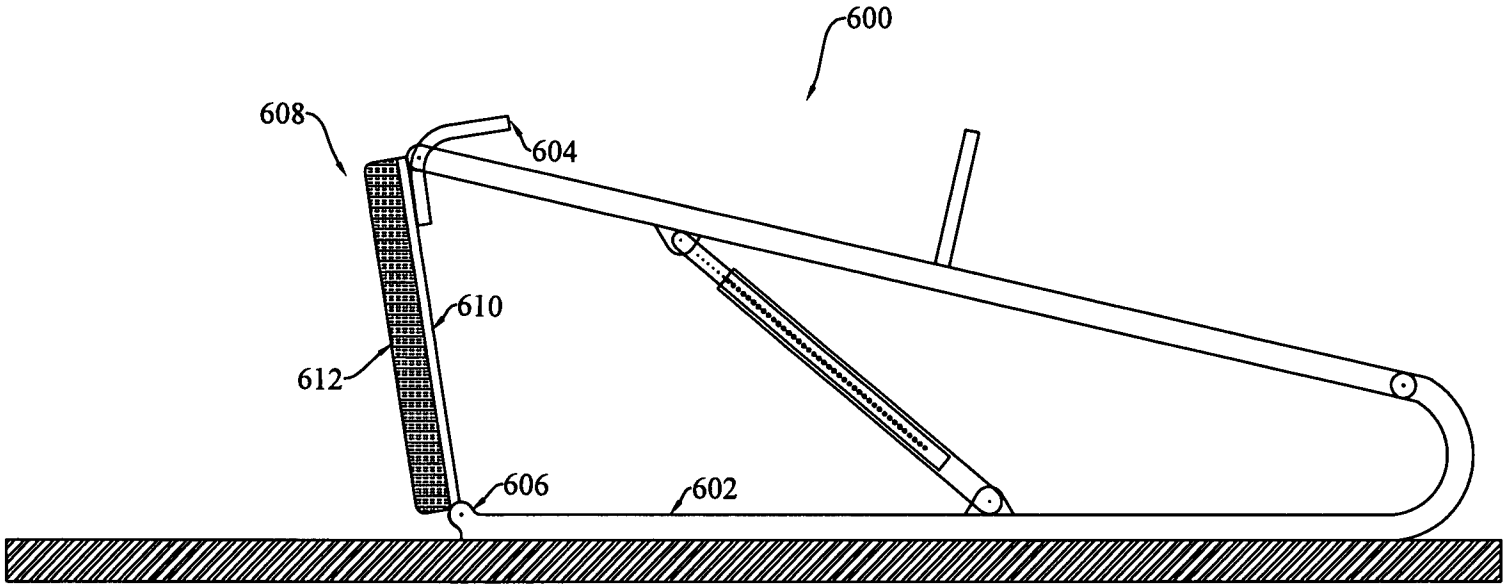
FIGS. 6A and 6B depict aspects of an embodied sled with padding for additional training exercises.

FIG. 6A depicts sled 600 with shoulder member 604, which may be the same or similar to corresponding elements depicted in the other figures. Push member 608 includes push member frame 610 which extends from shoulder member 604 to push member mount 606. As shown, push member mount 606 is integrated into friction member 602. Padding 612 is mounted to push member frame 610. Push member 608 is optionally added to a training sled if football lineman drills, for example, are to be performed during training. A football player, for example, may run drills in which push member 608 simulates an opposing player that is to be blocked or tackled. Push member frame 610 may be rigid or may be made of a flexible material (e.g., plastic, synthetic material, rubber, fiber material) that permits push member 608 to flex when it is hit by an athlete. To this end, push member mount 606 may include a spring or other shock absorbing mechanism (not depicted). As shown, shoulder member 604 is rotated (as compared to shoulder member 104 in FIG. 1) to permit mounting push member 608. To absorb shocks distributed to push member 608, shoulder member 604 and its mount may include spring action (e.g., through a torsion spring, not depicted).

Figure 6B:
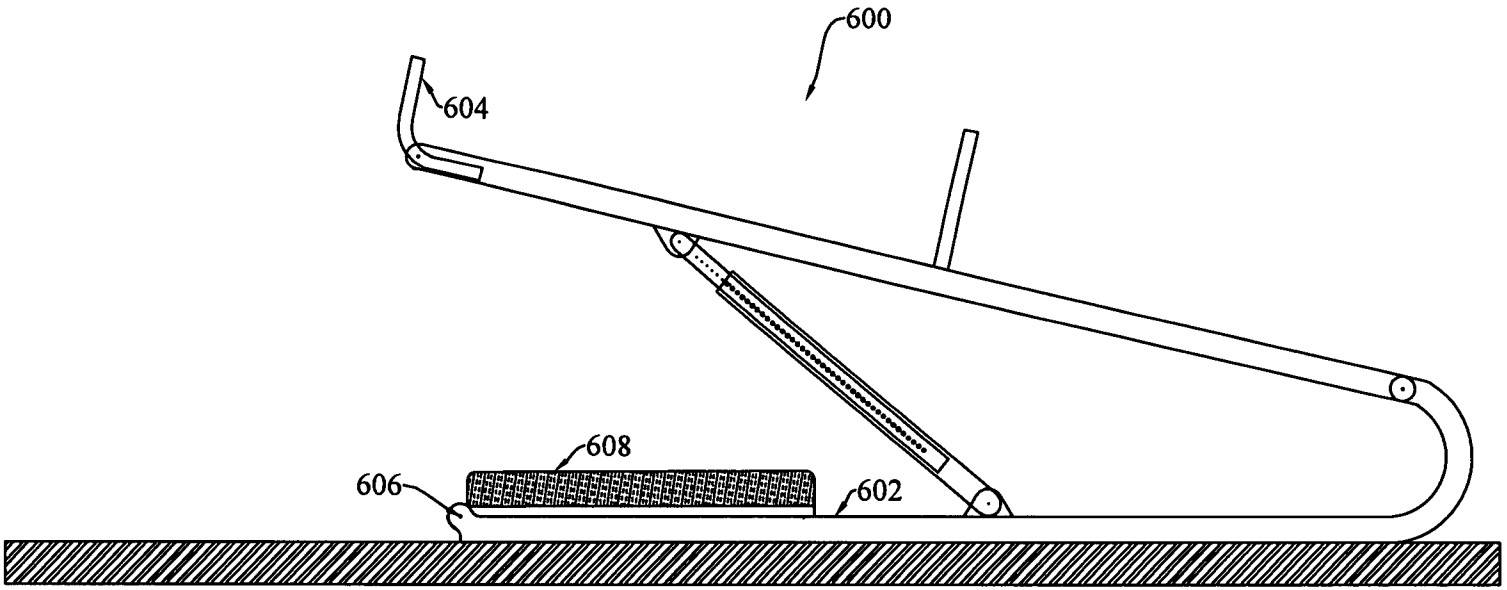

FIG. 6B depicts sled 600 from FIG. 6A with push member 608 rotated for storage. As shown, shoulder member 604 is temporarily rotated at push member mount 606 to permit shoulder member 608 to rotate downward for storage. Push member 608 rests on friction member 602 when not in use, or it can be removed.

Figure 7:
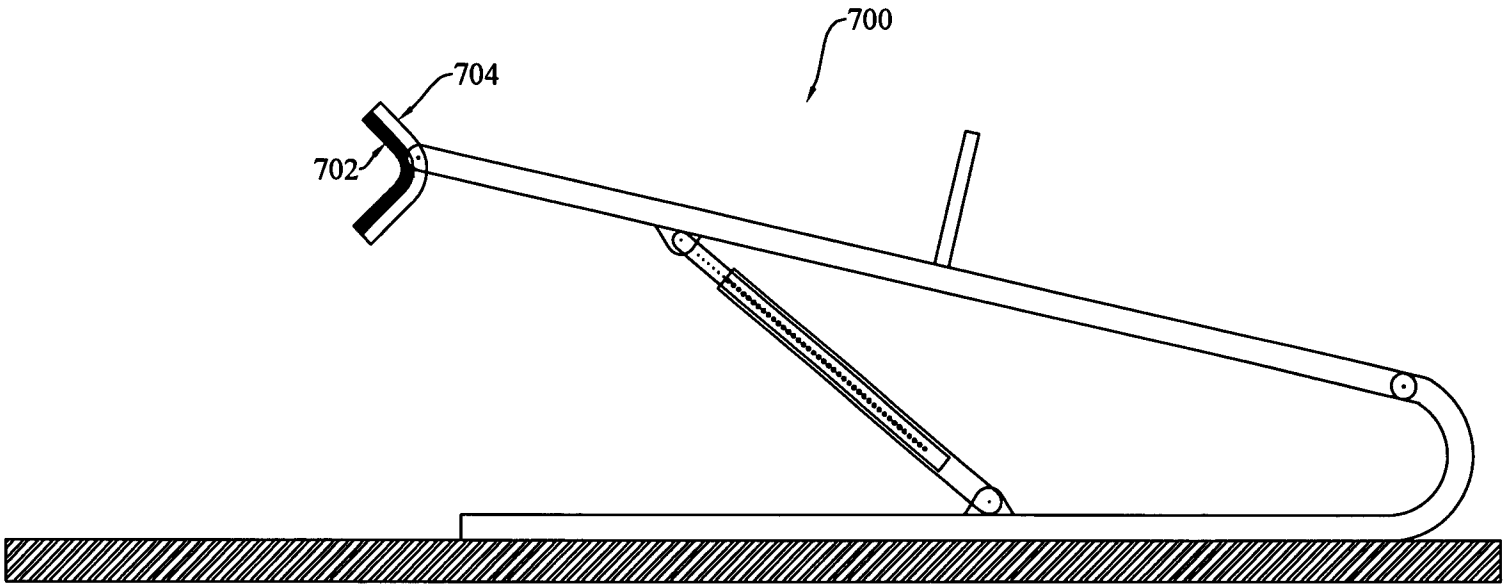
FIG. 7 depicts aspects of an embodied sled with padding for the shoulder member.

FIG. 7 depicts sled 700 with added pad 702. Sled 700 may be identical to or similar to the sleds depicted in the other figures. Pad 702 provides relief to an athlete from having any hard surfaces of shoulder member 704 contacting the athlete's shoulders during use. Foam covered by a synthetic material (e.g., vinyl) may be used for pad 702 and padding 612 (FIG. 6A). Pad 702 and padding 612 may also include colors, logos, or other branding related to the manufacturer or sponsor of sleds 600 and 700. Alternatively or in addition, pad 702 and padding 612 may include colors, logos, and branding related to the provider of services (e.g., training services) in which sleds 600 and 700 are used.

Patented embodiments are not necessarily restricted to embodiments described above. The appended claims and elemental equivalents cover claimed embodiments:

What is claimed:

1. A resistance training sled for use by athletes, the sled comprising:

an upper member having first and second ends;

a friction member slidably contacting a playing surface and pivotably connected to the second end of the upper member;

an adjustable shoulder member pivotably positioned on the first end of the upper member, the shoulder member adjustable to provide optimized angles with respect to the playing surface for:

1) simulating actual running conditions, and 2) carrying out a particular training regimen;

at least one extendable cross member pivotably connected between the upper member and the friction member, wherein the at least one cross member provides support and rigidity between the friction member and the upper member, and one or more weight holders are attached to the friction member, the upper member and the shoulder member, and wherein the weight holders provide weight lifting resistance for an athlete when in use.

2. The training sled of claim 1, wherein the should member includes padding.

3. The training sled of claim 1, wherein the at least one cross member further comprises:

at least one cross member extender that is extendable toward the upper member and at least one cross member pin for fixing the at least one cross member extender to the at least one cross member.

4. The training sled of claim 1, wherein the upper member is connected to the shoulder member by a pivotal shoulder member union and the pivotal shoulder member union is adjustable to adjust the optimized angle between an athlete and the friction member between 40° and 60°.

5. The training sled of claim 3, wherein the friction member comprises first and second friction members, the first and second friction members are coupled together by at least one support member.

6. The training sled of claim 4, wherein the upper member comprises a first and second upper members and the at least one cross member is a pair of cross members pivotably connected to the first and second upper members and the first and second friction members.

7. The training sled of claim 5, wherein the shoulder member is first and second shoulder members and the first and second shoulder members are shaped concavely, substantially forming a right angle.

* * * * *